United States Patent [19]

Uchikawa

[11] 4,359,039

[45] Nov. 16, 1982

[54] SELF-CLEANING PLATE

[75] Inventor: Fusaoki Uchikawa, Kamakura, Japan

[73] Assignee: Mitsubishi Denki Kabushiki Kaisha, Japan

[21] Appl. No.: 182,610

[22] Filed: Aug. 29, 1980

[30] Foreign Application Priority Data

Oct. 4, 1979 [JP] Japan ..... 54-137592[U]

[51] Int. Cl.[3] ..... A21B 1/00

[52] U.S. Cl. ..... 126/19 R; 126/273 R

[58] Field of Search ..... 126/19 R, 273 R; 220/457, 458; 428/547, 550

[56] References Cited

U.S. PATENT DOCUMENTS

| | | | |
|---|---|---|---|
| 3,266,477 | 8/1966 | Stiles | 126/19 R |
| 3,271,653 | 9/1966 | Wolf | 220/458 |
| 3,419,414 | 12/1968 | Marks | 220/458 X |
| 3,732,857 | 5/1973 | Williamitis | 126/19 R |
| 3,988,514 | 10/1976 | Denny et al. | 126/19 R |
| 3,993,597 | 11/1976 | Stiles | 126/19 R |
| 4,029,603 | 6/1977 | Denny et al. | 126/19 R X |
| 4,062,806 | 12/1977 | Roberts | 126/19 R |
| 4,147,835 | 4/1979 | Nishino et al. | 126/19 R X |
| 4,180,482 | 12/1979 | Nishino et al. | 126/19 R X |

*Primary Examiner*—Larry Jones

*Attorney, Agent, or Firm*—Wenderoth, Lind & Ponack

[57] ABSTRACT

This invention relates to a self-cleaning plate of a metallic porous body having a three dimensional network structure and a specific surface area of at least 2,000 $m^2/m^3$ or more, characterized by having oxidation catalyst particles uniformly distributed throughout the binder with which the framework of said porous body is coated and with which the porosities are filled, said binder being preferably any one of an alkali metal silicate, a colloidal silica, a colloidal alumina, a monobasic metal phosphate, and a silicone resin, said oxidation catalyst being preferably at least one selected from the group of metals Pt and Pd or the metal oxides of Mn, Cr, Ni, Co, Cu, and Fe.

5 Claims, 6 Drawing Figures

SELF-CLEANING PLATE

BACKGROUND OF THE INVENTION

The present invention relates to self-cleaning plates which are applied in cooking appliances as cooking members such as the inner walls of the cooking appliance, and which at cooking temperature can automatically clean off dirt such as the fat and grease that spatters from food during cooking.

As to methods for automatically cleaning off the dirt that spatters onto the inner wall surfaces of cooking appliances when food is being cooked by a cooking appliance such as an oven, an oven toaster, or a microwave oven, there have been disclosed by, to begin with, U.S. Pat. No. 3,266,477, as well as U.S. Pat. Nos. 3,547,098, 3,580,733, 3,598,650, 3,671,278, and 3,759,240, and Japanese Patent Publication No. 17832/1972, and a number of others besides. The self-cleaning method which forms the mainstream of these disclosures is that of oxidative destruction of the dirt that is spattered from food at cooking temperature, by the action of an oxidation catalyst contained in a porous layer formed using a glass frit as a binder, that is to say, as a coating layer forming material, and forming a porous layer by coating and baking it on a base layer of enamel coated onto a metal substrate. By the action of this oxidation catalyst contained in the porous layer, the dirt spattered from the food during cooking is oxidatively destroyed. However, there are defects such that at high temperatures of 800° C. or more, these calcine, and so the fusion and sintering of the particles of oxidation catalyst occur, reducing the cleaning performance, such that if the sheet is not of a certain thickness it may distort, it use a large amount of energy, a high temperature calcining furnace is needed and the catalyst layer cannot be made thick. To remedy these defects substances using an alkali silicate as the binder, such as, for instance, in Japanese Patent Publication No. 28120/1974, have been proposed. As a binder type, this belongs to the heat resistant coating group, and a calcining temperature of about 260° C. to 316° C. (500° F. to 600° F.) is sufficient, and so it could be said that it remedies the aforementioned defects. In the inventor's experiments it was also confirmed that inorganic coating agents of silicas, aluminas or phosphates can be used as binders with the aforementioned advantages and which are capable of forming a porous coating with heat resistant properties. However, the facts are that when a binder containing catalytic particles is coated onto a substrate metal (steel plate, stainless steel plate, aluminized steel plate, etc.) it has poor adhesion to the substrate, produces cracks due to heat shock and steam, etc., and peels off easily, and when it is used in a cooking appliance, a long life for the coating layer cannot be guaranteed.

The present invention, giving full consideration to the aforementioned circumstances presents a self-cleaning plate of high cleaning capability and which eliminates the defects present in the prior art.

SUMMARY OF THE INVENTION

An object of this invention is to provide a self-cleaning plate of a metallic porous body characterized by having oxidation catalyst particles uniformly distributed throughout the binder with which the framework of said porous body is coated and with which the porosities are filled.

Said metallic porous body preferably has a three dimensional network structure and a specific surface area of at least 2,000 $m^2/m^3$ or more.

The main component of said binder is preferably any one of an alkali silicate, a colloidal silica, a colloidal alumina, a monobasic metal phosphate, and a silicone resin.

Said oxidation catalyst is preferably at least one selected from the group of metals Pt and Pd or the metal oxides of Mn, Cr, Ni, Co, Cu, and Fe.

DESCRIPTION OF THE PREFERRED EMBODIMENT

Hereinbelow the present invention is explained in detail with reference to the drawings and embodiments.

Figure 1:
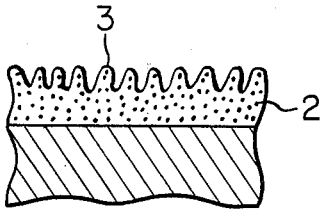
FIGS. 1 and 2 are respectively enlarged cross-sectional sketches of a prior art self-cleaning type coating layer and a self-cleaning plate according to this invention.

FIG. 1 is an enlarged cross-sectional sketch of a prior art heat resistant coating group self-cleaning type coating layer of a substrate metal (aluminized steel plate) (1) on which a coating (2) of an alkali silicate, as a binder, is provided. (3) Represents the oxidation catalyst particles distributed and contained in the alkali silicate coating (2).

Figure 2:
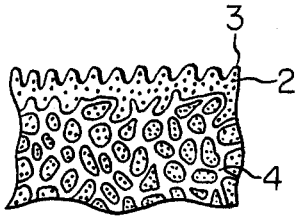

FIG. 2 is an enlarged cross-sectional sketch showing a self-cleaning plate according to the present invention. (4) Is a metallic porous body which serves as a substrate and serves to firmly bind the coating (2), and it employs a material having a three dimensional network structure. The material is Ni. Apart from Ni, as materials for a metallic porous body, Cu, Fe, Ag, Al, Ni-Cr alloys, and Fe-Cr alloys are available, and as long as there is corrosion resistance and heat resistance to about 400° C., any of these may be used. Also, the metallic porous body may, instead of the three dimensional network structure, as in the above embodiment, employ a calcined powder and a fibrous metallic porous material. However, according to the inventor's experiments, a material with a three dimensional network structure gives the highest degree of porosity among these porous bodies, which is to say it is possible to raise the effective surface area of the oxidation catalyst, and therefore it is the best. In use, unless it has a specific surface area of at least 2000 $m^2/m^3$ it is difficult to coat a coating (2) containing an oxidation catalyst (3) in a binder on the structure of a metallic porous body as in FIG. 2, and to fill up the porosities, and even if, for example, this can be done, it is difficult to manufacture a material which is strong and durable. However, when a material with a specific surface area of more than 2000 $m^2/m^3$ is used, the capillary effect becomes very strong and when dirt adheres there is plenty of opportunity for it to be absorbed inside and so come into contact with the oxidation catalyst particles, thus revealing outstanding cleaning performance. Consequently, in the present invention, when a metallic porous body with a three dimensional network structure is used, the relative surface area should be 2000 $m^2/m^3$ or more.

Also, with a plate type metallic porous body, whether one uses the brush method, the spray method, or the dip method, it is possible to fill the porosities not just on one side but on both sides with a compound containing oxidation catalyst particles. And, as apparent in FIG. 2, it is possible by not coating so that the surface is flat and thick, but by coating so that the surface is as thin as possible, retaining the surface shape of the metallic porous body, to improve workability and wear resistance.

Next, in order to investigate the adhesion to the substrate metal and workability with respect to a prior art heat resistant coating material as shown in FIG. 1, coated with an alkali metal silicate, and with respect to a self-cleaning plate according to this invention, as in FIG. 2, heat cycle tests (400° C.⟷room temperature each for 1 hour being 1 cycle), boiling water tests, and Erichsen tests were carried out. The results of these are shown in table 1. As will be observed from the results in table 1, the self-cleaning plate of this invention formed as in FIG. 2 has a strong bonding of the metallic porous body and the binder containing the oxidation catalyst, and does not easily produce peeling or cracks.

TABLE 1

| | Prior Materials | Material of this Invention |
|---|---|---|
| Heat Cycle Test | Partial peeling at 4 cycles | Nothing unusual after 50 cycles |
| Boiling Water Test | Partial peeling at 2 hours | Nothing unusual after 50 hours |
| Erichsen Test | Cracks produced with 1.5 mm protrusion | Nothing unusual with 3.5 mm protrusion |

Adhesion and workability were investigated by the same tests as in table 1, with regard to the use of a shot blast steel plate and a steel in which the surface was roughened by etching, as the substrate metal, but the self-cleaning plate of the present invention was vastly superior to both of these. The reasons for this are that in the material of the present invention the binder gets inside the vacant pores of the metallic porous body and is firmly locked to the metallic porous body as an aggregate. Accordingly, as the binder, apart from the alkali silicate used in the aforementioned embodiment, even general inorganic coating materials (or ceramic coating materials) which are known to easily produce cracks and peeling due to the difference of thermal expansivity with the substrate metal, may be used. In the inventor's experiments it was found that a self-cleaning plate which has a high oxidative catalytic effect yet which is as tough as with the alkali metal silicate used in the aforementioned embodiment, can be produced using a material in which an inorganic coating material of a colloidal silica, a colloidal alumina, or a monobasic metal phosphate (for instance, monobasic calcium phosphate, etc.) and a silicone resin are coated and then calcined at high temperature (350° C. or more).

Next, some examples of the application of the present invention to self-cleaning plate cooking appliances, are given.

Figure 3:
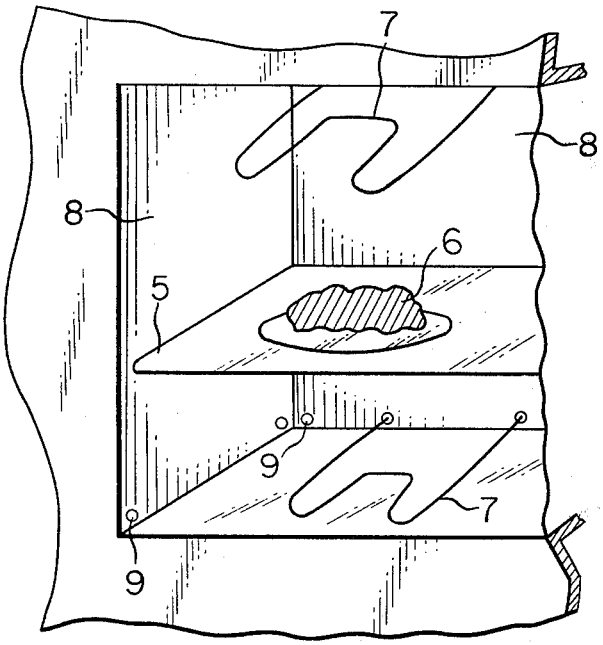
FIG. 3 shows an application of the self-cleaning plate of the present invention to the inner walls of a cooking appliance chamber.

FIG. 3 illustrates an embodiment in which the self-cleaning plate of the present invention is applied to the inner wall (8) of a cooking appliance chamber, (5) is a cooking tray, (6) is a food, and (7) is a heater for cooking. In order to affix the self-cleaning plates to the inner wall of a cooking appliance, it may, as shown in FIG. 3, be retained by screws (9). It is not shown in FIG. 3, but the self-cleaning plate of the present invention may also be applied to the inner ceiling board of a cooking appliance chamber, and as such position is difficult to clean, this may be considered a very effective application. FIG. 3 shows an example of the application of a self-cleaning plate of the present invention to an electric type oven, but it goes without saying that it may also be applied in the same way to oven toasters, microwave ovens and gas ovens.

Figure 4:
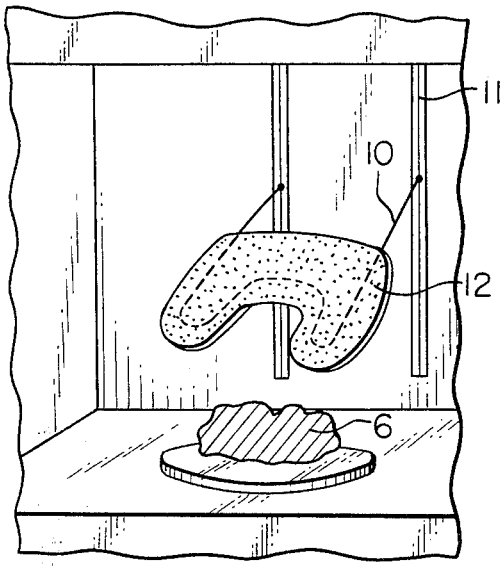
FIG. 4 shows an application of the same to a reflector plate for cooking.

FIG. 4 illustrates an embodiment wherein a self-cleaning plate of this invention is applied to the reflector plate (12) employed in a disposition above a movable heater (10) in an electric cooking appliance of the type where a heater is movable up or down. (11) Is a groove (rail) for the upwards and downwards movement of movable heater (10). Reflector plate (12) reflects the heat of heater (10), whereby the heating efficiency with regard to the food substance (6) is increased, and also serves the function of catching dirt from the food substance (6) during cooking thereby preventing widespread spattering.

When a self-cleaning plate manufactured as that in FIG. 2 with aluminum phosphate (a monobasic aluminum phosphate) as the binder and manganese dioxide as the oxidation catalyst, and applied to cooking appliances as in FIGS. 3 and 4, was used repeatedly in cooking, it was confirmed that dirt spattering from food substances was thoroughly cleaned off during cooking.

Figure 5:
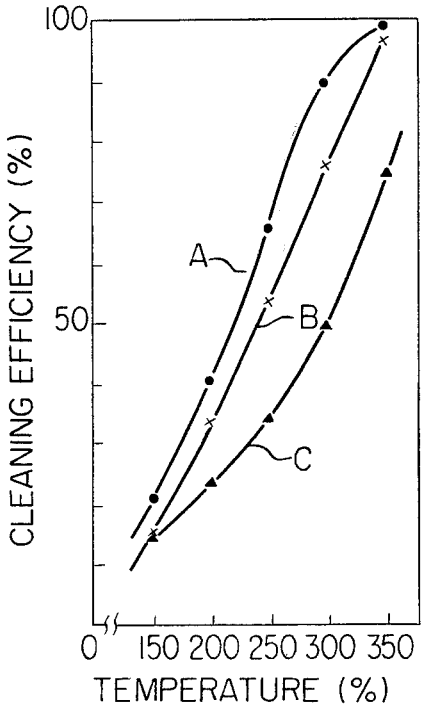
FIGS. 5 and 6 are characteristics graphs showing the dirt cleaning performance of the self-cleaning plate of this invention.
Figure 6:
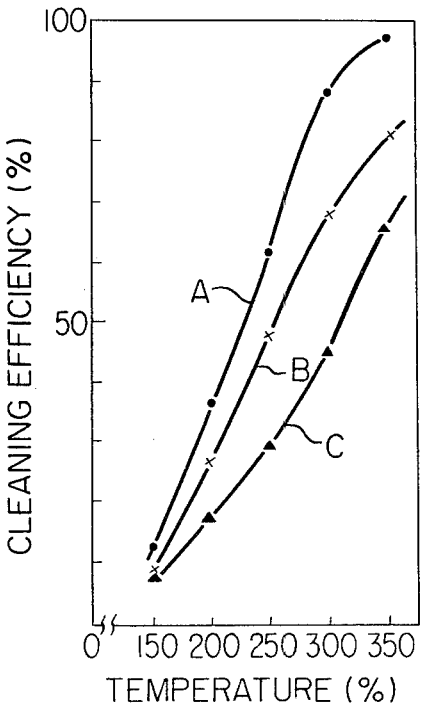

Also, the dirt cleaning performance of the self-cleaning plate of the present invention manufactured as in FIG. 2 was measured in comparison to that of the prior art heat resistant coating type, and the enamel type, as shown in FIG. 1. The cleaning efficiency characteristics were established by adhering about 50 mg of butter to about 10 points on the surfaces of the respective plates and measuring the weight change after heating them in an electric oven at temperatures at 50° C. intervals from 150° C. to 350° C. for 20 minutes at each temperature. The results thereof are shown in FIGS. 5 and 6. In both, curve (A) shows the characteristics of an embodiment of this invention, curve (B) shows the characteristics of the prior art heat resistant coating type, and curve (C) shows the characteristics of the prior art enamel type. In FIG. 5, Pt is used as the oxidation catalyst, and in FIG. 6 a mixture of oxides of Ni and Cu is used for the same purpose. Both the present inventive and the prior art heat resistant type coating use aluminum phosphate as the binder. As will be observed from FIGS. 5 and 6, the cleaning efficiency of the self-cleaning plate of this invention is superior to either of the prior coating layers at all temperatures. The reasons for the deterioration of the cleaning performance of the enamel type have already been discussed. The reasons why this invention is superior to the prior art heat resistant type coating are felt to be that the porous body structure as in FIG. 2 forms a framework and so dirt that adheres to the surface permeates into the pores by capillary action and so has plenty of opportunity to come into contact with the contained oxidation catalyst, and that unlike a plate formed with a coating layer on a flat sheet, the thickness of the membrane possessing the oxidative catalytic effect (i.e. the thickness of the metallic porous body) can be made as thick as is desired (which also gives long life), so as above, there is plenty of opportunity for the dirt to come into contact with the oxidation catalyst.

When cleaning efficiency with regard to salad oil, sauce, sugared water, gravy, lard, and fish oil was measured in the same way as in the above example, it was confirmed that this invention has a vastly superior performance to any of the prior plates.

Further, on comparing FIG. 5 and FIG. 6, it will be seen that even without using an expensive Pt as the oxidation catalyst, as in FIG. 5, a substantially high cleaning efficiency is also exhibited at temperatures of about 250°–300° C. with oxides of Ni and Cu. Generally, as catalysts for the oxidation, dispersions of organic substances, platinum group metals and oxides of other metals are known, the former having the ability to adsorb and desorb oxygen from the air, and the latter by the action of the oxygen in air and the oxygen in their own constructions, respectively achieve the oxidative catalytic effect. According to the inventor's experiments conducted in the same way as for FIGS. 5 and 6, as to oxidation catalysts for cleaning off dirt such as grease, butter, salad oil, and seasonings, spattered from food, among metal, apart from Pt, metallic particles of Pd, and among metal oxides, apart from oxide particles of Ni and Cu, oxide particles of Mn, Cr, Co, and Fe, too, have outstanding dirt cleaning efficiency, and it was found that they can be used to particular effect in this invention. Also, in this invention at least one of the above oxidation catalysts is contained together with another additive in a binder. Among these oxidation catalysts one which is relatively cheap and high in cleaning efficiency, and which is also most desirable from the points of view of hygiene and pollution, is an oxide of Mn, and the $\gamma$ (gamma) type manganese dioxide, particularly, is very high in activity and exhibits outstanding catalytic effects. However, $\gamma$-$MnO_2$ has the characteristic that when it is heated to a temperature of about 400° C. or above, it transforms into $\alpha$ (alpha) type or $\beta$ (beta) type, and the activity is reduced. That is to say, when $\gamma$-$MnO_2$ has been used in the coating layers of glass (enamel) frit which at present is the most generally and widely used, said phenomenon occurs as the calcining temperature is high (normally 800° C. or more, and even in those with a low softening point it is about 500° C.), and the catalytic performance is diminished. In this point, too, with a self-cleaning plate of this invention, as described above, it is possible to use even a binder which, like alkali metal silicate, colloidal silica, colloidal alumina, a monobasic metal phosphate, or silicone resin, containing an oxidation catalyst is difficult to form into a membrane, or of which the membrane life is short, and when these are used a calcining temperature of about 250°–370° C. is sufficient, which is advantageous as even with a $\gamma$-$MnO_2$ the activity is not reduced.

As explained hereinabove, when the self-cleaning plate of the present invention in which in a metal porous body, covering its framework and filling the porosities thereof are oxidation catalyst particles uniformly contained and dispersed in the entirety of a binder, is applied to the inner walls of a cooking appliance chamber, and as members for use during cooking, not only is it possible for the dirt spattered from food to be automatically cleaned with higher efficiency than with prior art types, at relatively low temperatures, but also it is of extremely high practical value as peeling and cracking of the binder do not readily occur and it is tough and has a long life.

What we claim is:

1. A self-cleaning plate comprising a metallic substrate layer and a coating layer, wherein said substrate is a continuous three dimensional porous material, wherein the pores are filled with a binder having oxidation catalyst particles uniformly distributed therein and wherein said coating layer also comprises said binder having said oxidation catalyst particles uniformly distributed therein.

2. The self-cleaning plate as claimed in claim 1 wherein said material has a specific surface area of at least 2,000 $m^2/m^3$ or more.

3. The self-cleaning plate as claimed in claim 1 or 2 wherein the main component of said binder being an alkali metal silicate, a colloidal silica, a colloidal alumina, a monobasic metal phosphate, or a silicone resin.

4. The self-cleaning plate as claimed in claim 1 or 2 wherein said oxidation catalyst is at least one member selected from the group consisting of Pt metal, Pd metal, Mn oxide, Cr oxide, Ni oxide, Co oxide, Cu oxide, and Fe oxide.

5. The self-cleaning plate as claimed in claim 3 wherein said oxidation catalyst is at least one member selected from the group consisting of Pt metal, Pd metal, Mn oxide, Cr oxide, Ni oxide, Co oxide, Cu oxide, and Fe oxide.

* * * * *